US006173579B1

(12) United States Patent
Davidson

(10) Patent No.: US 6,173,579 B1
(45) Date of Patent: Jan. 16, 2001

(54) SEALED LIQUID CONTAINER

(76) Inventor: Paul Davidson, 18 Ploughman's Way, Tytherington, MacClesfield, Cheshire (GB), SK10 2UN ( * ) Notice: Under 35 U.S.C. 154(b), the term of this patent shall be extended for 0 days.

(21) Appl. No.: 09/214,583

(22) PCT Filed: Jul. 4, 1997

(86) PCT No.: PCT/GB97/01816

§ 371 Date: Feb. 16, 1999

§ 102(e) Date: Feb. 16, 1999

(87) PCT Pub. No.: WO98/01364

PCT Pub. Date: Jan. 15, 1998

(30) Foreign Application Priority Data

Jul. 4, 1996 (GB) ..... 9614023

(51) Int. Cl.[7] ..... F25D 3/10
(52) U.S. Cl. ..... 62/293; 62/371
(58) Field of Search ..... 62/293, 294, 371, 62/4

(56) References Cited

U.S. PATENT DOCUMENTS

| | | | | |
|---|---|---|---|---|
| 1,897,723 | * | 2/1933 | Free | 62/294 |
| 2,515,840 | * | 7/1950 | Rodeck | 62/294 |
| 3,520,148 | * | 7/1970 | Fuerle | 62/294 |
| 3,881,321 | | 5/1975 | Riley | 62/294 |
| 4,584,848 | * | 4/1986 | Barnett | 62/294 |
| 4,893,730 | | 1/1990 | Bolduc | 222/80 |
| 4,989,729 | * | 2/1991 | Huang | 62/294 |
| 5,214,933 | * | 6/1993 | Aitchison et al. | 62/294 |
| 5,325,680 | | 7/1994 | Baroso-Lujan et al. | 62/294 |
| 5,609,038 | * | 3/1997 | Halimi | 62/294 |

FOREIGN PATENT DOCUMENTS

| | | |
|---|---|---|
| 3522639 | 1/1987 | (DE) . |
| 2211478 | 7/1989 | (GB) . |
| 2298180 | 8/1996 | (GB) . |

* cited by examiner

*Primary Examiner*—William E. Tapolcai
(74) *Attorney, Agent, or Firm*—Edwin D. Schindler

(57) ABSTRACT

A beverage containing system comprises a sealed drink can 1 having located therein both a liquid 11 to be consumed and a sealed compartment 13. The system includes means 33 for rupturing a wall 23 of the compartment to put its interior in fluid communication with a further compartment 15. A compressed fluid is located in one of the compartments whereby, after the rupturing of the wall, the fluid is confined within the compartments.

25 Claims, 4 Drawing Sheets

SEALED LIQUID CONTAINER

This invention relates to sealed liquid containers and especially, but not exclusively, to drink cans of the well known type which contain soft or alcoholic drinks and which may be opened by pulling a tab or the like located at one end of the can.

It is often desirable for the liquid within a drink can to be cooled, gasified or further gasified prior to drinking.

Cooling is normally achieved by placing a can within a refrigerator, the contents of the can being drunk shortly after removing it from the refrigerator. However, this is not always a matter of convenience.

A self-refrigerating drinks can has recently been proposed in which the cooling is effected by the expansion of a liquid hydrofluorocarbon which is allowed to escape into the atmosphere. Accordingly, there are environmental objections to this proposal.

There are on the market various beer cans which incorporate a "widget" for effecting the gasification of the contents of the can. However, the operation of the widget is only actuated once the entire can is opened and the resultant gasification process may cause uncontrolled outflow of the liquid from the can.

There is a need for a drink can having contents which can be cooled rapidly, particularly in the case where a drink can has not been stored in a refrigerator and the contents are to be consumed immediately or very quickly so that there is no time to allow them to be cooled in the refrigerator, even if one is available.

There is also a need for a drink can having contents which can be gasified in a controlled manner.

According to the present invention there is provided a beverage containing system comprising a sealed drink can having located therein both a liquid to be consumed and a sealed compartment, and means for rupturing a wall of said compartment to put the interior of said compartment in fluid communication with a further compartment, a compressed fluid being located in one of said compartments whereby, after said rupturing, the fluid is confined within said compartments.

In an embodiment of the present invention said further compartment is substantially the entire drink can.

In another embodiment of the present invention, said further compartment is a second sealed compartment within said drink can. In this case first rupturing means may be provided to enable said compartments to be put in fluid contact with each other and second rupturing means may be provided to put one of said compartments in fluid contact with the entire drink can.

The drink can may include a deformable circular cylindrical wall which is squeezable to effect said rupturing.

In a further embodiment of the present invention, the further compartment is located within a device separate from said drink can. In this case, the means for rupturing a wall of said compartment forms part of said device. The compressed fluid may be located in said further compartment.

The compressed fluid may be any suitable fluid which, on expansion, extracts heat from its surroundings to cool the can contents and/or is effective to gasify the liquid beverage contained within the can. Preferably the fluid is a liquid having a boiling point below 0° C. More preferably the fluid is nitrogen or carbon dioxide.

Embodiments of the present invention will now be described, by way of examples only, with reference to the accompanying drawings, in which.

Figure 1:
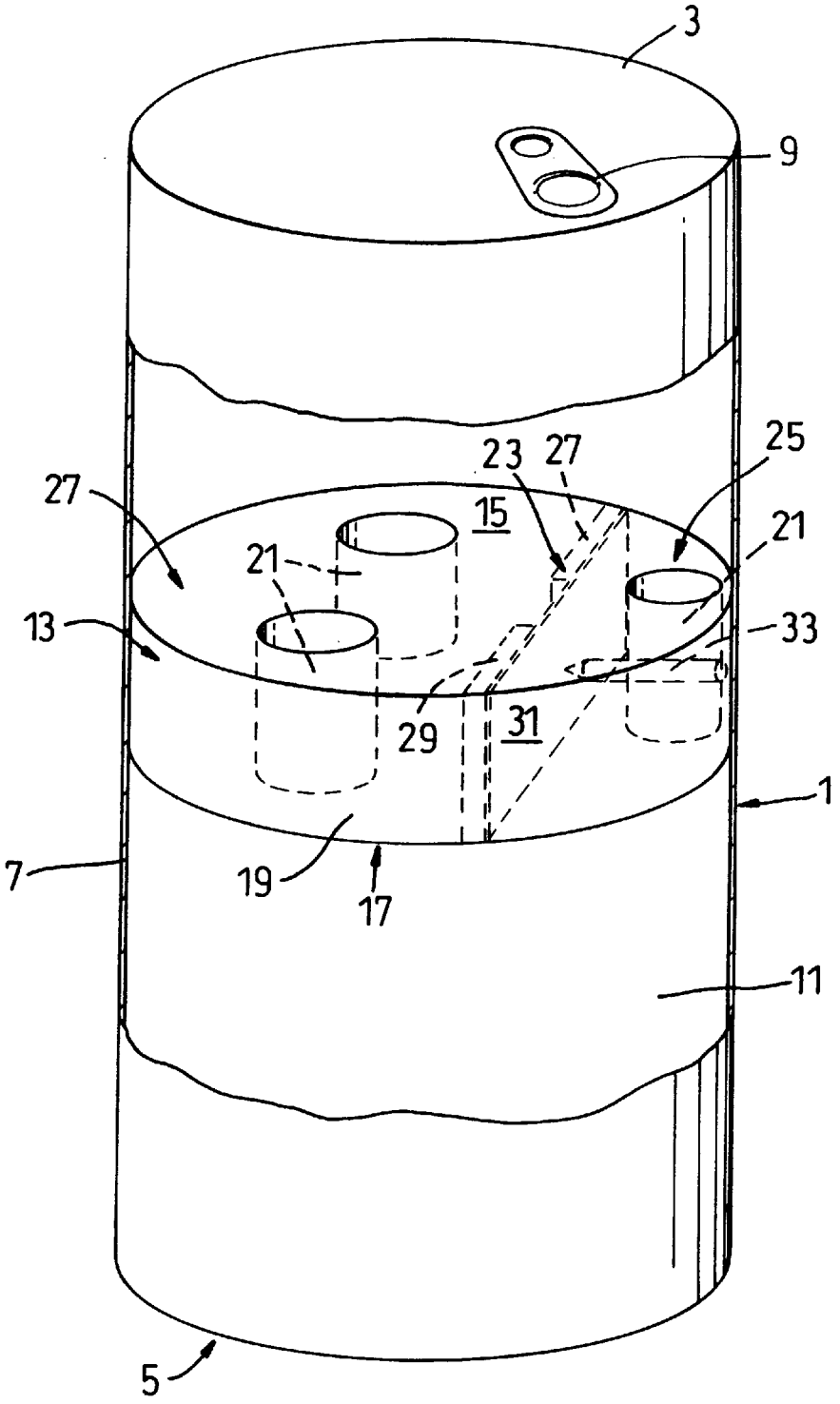
FIG. 1 shows a first embodiment of a beverage containing system of the present invention.

Referring to FIG. 1 of the accompanying drawings, a drink or beverage containing can 1 is, apart from its interior, of conventional form having a top 3, a base 5 and a circular cylindrical wall 7 extending between top 3 and base 5. Top 3 is provided with a tab or ring 9 which may be pulled away from top 3 to at least partially separate a portion of the top from the remainder of the top, thereby opening the can in this region. The contents 11 of the can, in the form of a consumable liquid which may or may not be in gasified form, can then be poured from can 1 into a suitable glass or other container or may be poured directly into the consumer's mouth.

Located within can 1 in a longitudinal central position therein is a compartment 13 which is sealed with respect to the remainder of the can and is in the form of a shallow cylindrical body. Compartment 13 is provided with a flat top 15 and a flat base 17, both parallel to the top 3 and base 5 of the can itself and both extending transversely across the entire interior of the can. Top 15 and bottom 17 are joined by a narrow band 19 which forms a circular cylindrical wall of the compartment and which is contiguous with the internal surface of the circular cylindrical wall 7 of can 1.

Compartment 13 has extending therethrough, between top 15 and bottom 17, three passageways 21, each of which is open at both ends to provide liquid communication between the interior of the can above and below the compartment 13.

Extending across compartment 13 in a direction at right angles to a radius thereof is a partition 23 which separates the compartment 13 into two sub-compartments 25 and 27. Partition 23 includes two rigid wall members 27 and 29 which extend towards each other from opposite circumferential positions of compartment 13, there being a central gap between the ends of wall members 27 and 29. Bridging this gap is a rupturable membrane 31 which is attached to one aligned side of each wall member 27, 29.

Compartment 13 is also provided with a spike or needle 33 which is fixed at one end to the circumferential wall 19 of compartment 13 and which extends, within sub-compartment 25, in a direction towards the central part of the membrane 31. Spike 33 is provided at its free end with a point which lies close to membrane 31.

Drink can 1 is made of any suitable material, typically a metal such as aluminium or tin, or an alloy thereof. The can 1 has a relatively rigid top 3 and base 5 and a thin, deformable circular cylindrical wall 7. Compartment 13 is formed of readily deformable material which again may be a suitable metal or alloy or a plastics material. Membrane 31 may be made of a thin plastics material such as polystyrene. Located within sub-compartment 25 of compartment 13 is a quantity of liquid nitrogen. Sub-compartment 27 is either empty or filled with a gas such as air.

With the drink can 1 held in the hand, it is, as with a normal drinks can, possible to squeeze the circular cylindrical wall 7 to cause inward deformation thereof. In the case of the present drink can, deformation in the appropriate area of the can, as indicated on its outside surface by appropriate markings, will cause spike 33 to move towards membrane 31 such that the point of spike 33 will contact the membrane 31 and rupture it. This allows the liquid nitrogen to expand rapidly into sub-compartment 27 and, in so doing, the nitrogen will boil or vaporise. As a result, the nitrogen will extract heat to provide latent heat of vaporisation from the consumable liquid contents of the can, thereby rapidly cooling said content. Once this action has been effected, the consumable contents of the can may be accessed as mentioned above, by means of a tab or ring 9 located in top 3 of can 1.

Figure 2:
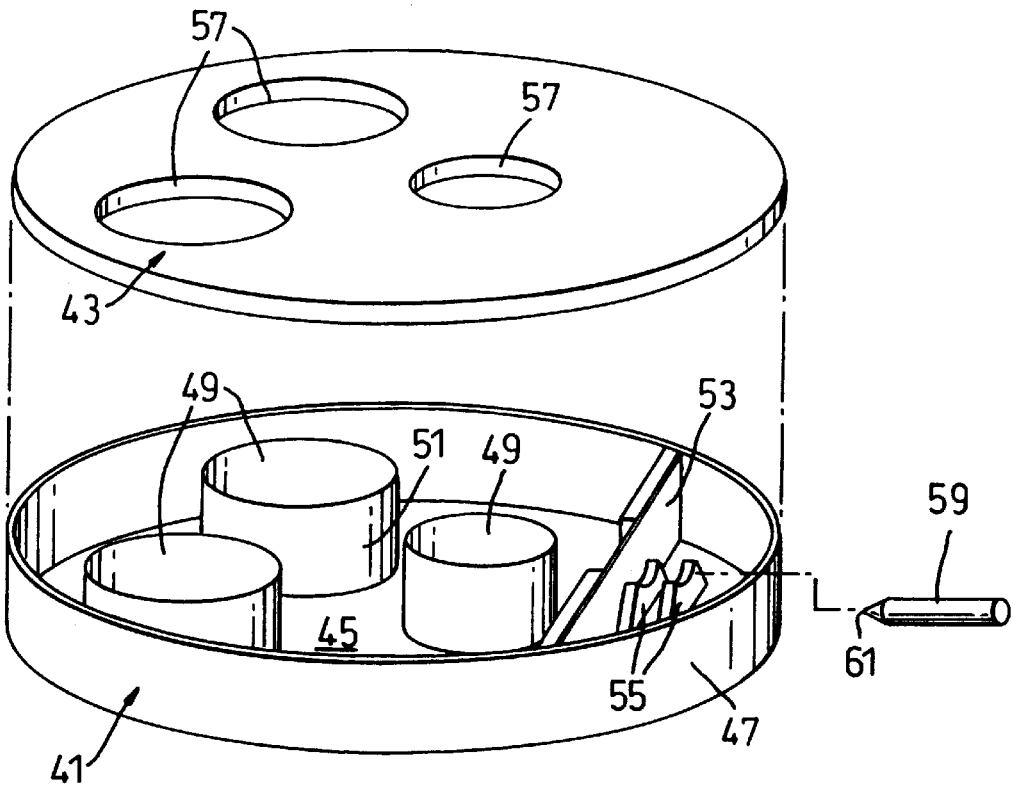
FIG. 2 shows one form of a drink can insert for a beverage containing system of the present invention.

Referring to FIG. 2 of the accompanying drawings, there is illustrated an insert compartment for a drink can, such as that described above, in the form of two injection moulded elements and a third element in the form of a plastics pin.

The two injection moulded elements together form the main body of the insert compartment. These elements are dish 41 and top 43. Dish 41 includes a base 45 and an integral circular side wall 47. Provided in base 45 are three holes 49, each of which has extending upwardly from the hole edge a circular wall 51 of substantially the same height as wall 47.

Extending across dish 41, in a direction at right angles to a radius thereof, is a partition 53 which separates the dish into two parts. Partition 53 is relatively thick except at a central portion thereof, as illustrated in FIG. 2. In the central portion of partition 53 the partition is equivalent to the rupturable membrane of the embodiment shown in FIG. 1.

Dish 41 is also provided with two pin guides 55 which are integral with dish 41 and extend upwardly from base 45 thereon. The two pin guides 55 are aligned along a radius of dish 41 with the central portion of partition 53. Each pin guide 55 has an upper concave surface as illustrated in FIG. 2.

The top 43 is a simple injection moulded piece of circular shape with holes 57 which correspond to the holes 49 of the dish 41.

The third item of the insert compartment shown in FIG. 2 is a simple plastics pin 59 provided with a sharp end point 61.

To assemble the insert compartment pin 59 is positioned on pin guides 55 with point 61 pointing towards and close to the central thin portion of partition 53. Top 43 is then located on dish 41 and sonic welded thereto. Liquid nitrogen is located in the larger sub-compartment of the insert which is then located with a drink can. Cooling of the can, prior to drinking the contents thereof, is effected in the same manner as that described in connection with the FIG. 1 embodiment.

Figure 5:
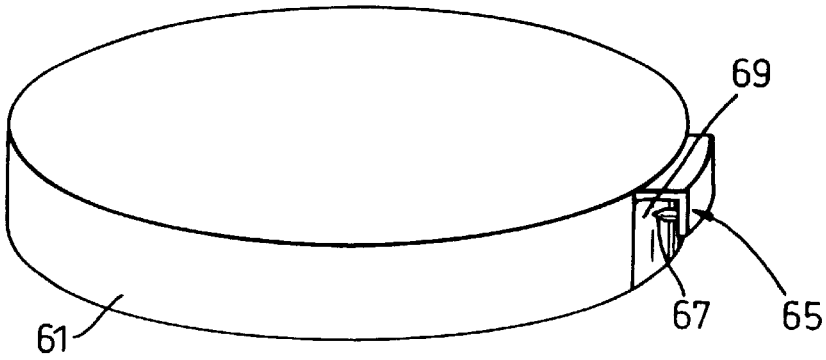
FIGS. 3 to 5 show another embodiment of an insert for a can forming part of a beverage containing system of the present invention.
Figure 3:
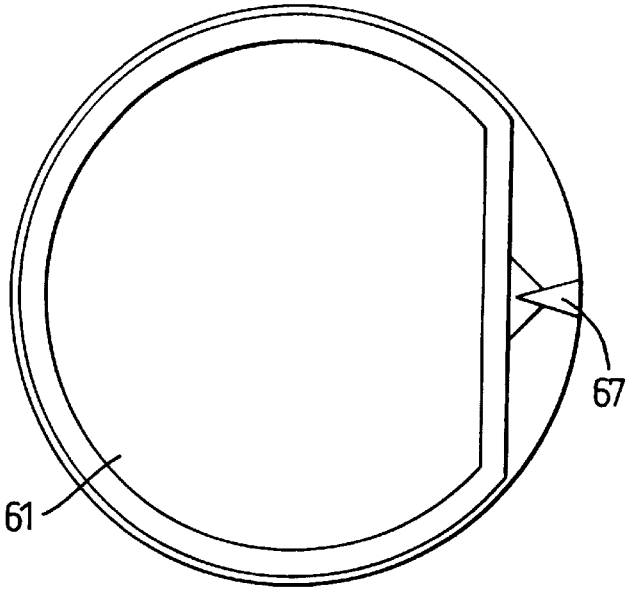
Figure 4:
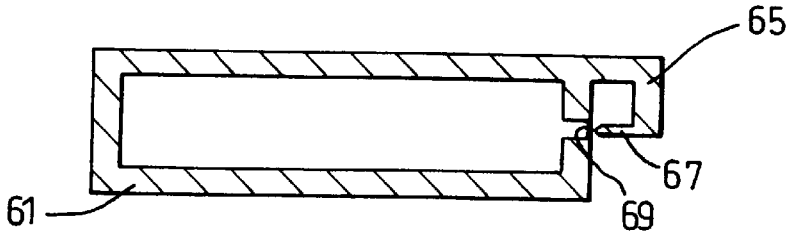

Referring to FIGS. 3 to 5, there is illustrated an insert compartment which is for use in gasifying the liquid beverage contained within a drink can. In this case the insert compartment 61 is in the form of a blow moulding filled with nitrogen gas. It is of substantially shallow cylindrical shape with dimensions such that it will fit within a standard drink can with its longitudinal axis aligned along the corresponding axis of the drink can. The main body of the insert compartment 61 is flattened in one region 61 thereof and there is provided, at this region, an integral bracket member 65 which extends outwardly and downwardly from the top of the insert compartment 61 and has attached thereto an inwardly directed spike or pin 67. Adjacent the sharp end of spike 67 the wall of the insert compartment is in the form of a thin integral membrane 69.

With the insert compartment 61 loaded within a drink can, the nitrogen gas may be allowed to escape by squeezing the can wall and causing spike 67 to rupture membrane 69. The gas escapes from the insert compartment into the surrounding liquid beverage, thereby gasifying, or further gasifying, this liquid. Such gasification may be effected before or after opening the main body of the can. It is a particular advantage of this embodiment of the present invention that gasification may be effected after the can has been opened. In this way, the difficulty with currently available cans containing "widgets", that the gasification is uncontrolled and may cause loss of beverage, is avoided.

Figure 6:
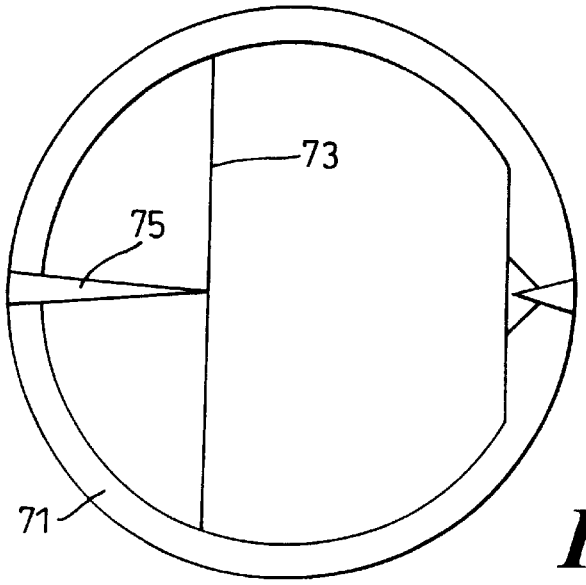
FIGS. 6 shows a further embodiment of an insert for a can forming part of a beverage containing system of the present invention.

Referring to FIG. 6 of the accompanying drawings, another embodiment of an insert compartment, to form part of a beverage containing system of the present invention, is similar to that described in connection with the FIGS. 3 to 5 embodiment. However, in this case the insert compartment 71 is divided into two sub-compartments by means of an internal partition 73. The right hand sub-compartment, as seen in FIG. 6, includes a membrane and pin arrangement similar to that described in connection with the FIGS. 3 to 5 embodiment. The left hand compartment is provided with a pin 75, extending from the circular wall of the compartment to a position where its sharp end is adjacent a central portion of partition 73. This central portion may be relatively thin compared with the remainder of the partition 73.

The left hand sub-compartment has located therein a quantity of liquid nitrogen. The right hand compartment may contain a vacuum or be filled with, for instance, air. The outside of the can is provided with indications as to the positions of the can which should be squeezed to operate both cooling and gasification, as will be explained below.

The drink can, within which insert compartment 71 is inserted, may first be cooled by squeezing the can adjacent pin 75, thereby causing pin 75 to rupture the central portion of partition 73. The liquid nitrogen then escapes from the left hand compartment into the right hand compartment, vaporising in so doing and drawing heat from the beverage located in the can, thereby cooling it. The next stage is to gaseous the can, either before or after opening it. Gasification is effective by squeezing the can adjacent the right hand pin, as seen in FIG. 6, thereby causing the now gaseous contents of compartment 71 to escape into the body of the liquid held in the can, causing gasification of this liquid.

Figure 7:
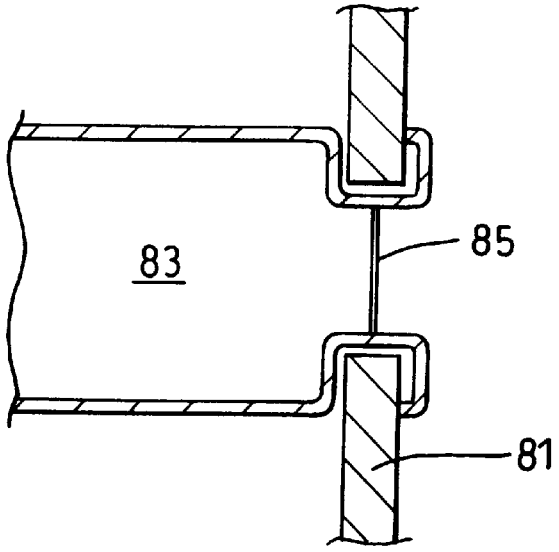
FIGS. 7 and 8 show detail of a further embodiment of a beverage containing system of the present invention.
Figure 8:
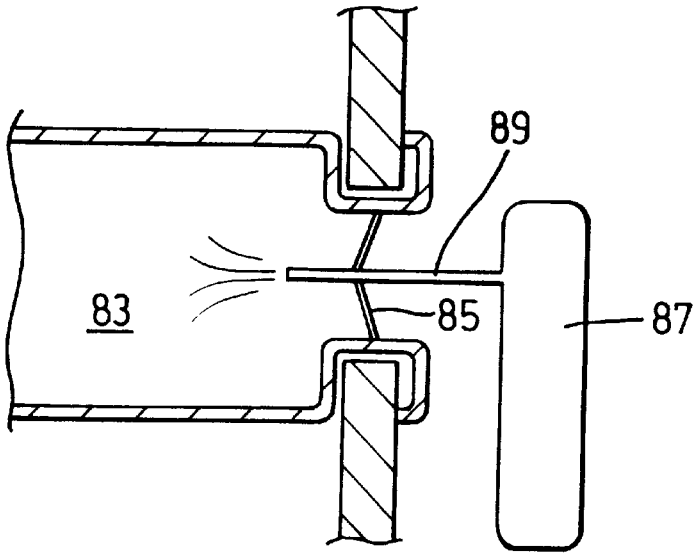

Referring to FIG. 7 and 8 of the accompanying drawings, there is illustrated part of another embodiment of a beverage containing system of the present invention. In this case a drinks can having a can wall 81 is provided with an internal compartment 83. A part of the side wall of compartment 83 forms a weakened area 85 of the wall of the can. Around this weakened area 85 which is of circular shape, the compartment 83 extends about the normal can wall edge forming a hermetic seal therewith.

As shown in FIG. 8, the beverage containing system includes a separate vessel 87 containing liquid nitrogen. Vessel 87 has extending therefrom a thin tube 89. By pushing the end of tube 89 into contact with membrane 85, the membrane may be ruptured and nitrogen may then be allowed to escape from vessel 87 into compartment 83, vaporising in so doing. The heat of vaporisation is extracted from the liquid contents of the drink can.

In the above described embodiments, reference is made to spikes, pins, or thin tubes all of which are capable of piercing thin membranes separating one compartment or sub-compartment from another. However, it should be appreciated that other embodiments in accordance with the present invention may have other means for putting two compartments into fluid communication with each other. Preferably such means will be capable of creating small or very small holes in membranes or other partitions between the compartments, the smallness of the holes assisting in the vaporisation, and therefore the extent of heat extraction, of the fluid.

What is claimed is:

1. A beverage containing system, comprising:

a sealed cylindrical drink can having located therein both a liquid to be consumed and a sealed first compartment and a second compartment, said sealed first compartment extending across said cylindrical drink can at a substantially central position located between end walls of said drink can; and, means for rupturing a wall of said sealed first compartment by squeezing at least a part of a deformable circular cylindrical wall of said drink can adjacent said sealed first compartment for effecting said rupturing of said wall of said sealed first compartment, thereby placing an interior volume of said sealed first compartment in fluid communication with said second compartment.

2. The beverage containing system according to claim 1, wherein said second compartment is substantially the entire interior of said sealed drink can.

3. The beverage containing system according to claim 1, wherein said second compartment is a second, sealed sub-compartment within said sealed drink can.

4. The beverage containing system according to claim 3, further comprising additional means for rupturing said sealed sub-compartment.

5. The beverage containing system according to claim 1, wherein said sealed first compartment is positioned transversely with respect to a longitudinal axis of said sealed drink can.

6. The beverage containing system according to claim 1, wherein said second compartment is located within a device separate from said sealed drink can.

7. The beverage containing system according to claim 1, wherein said sealed first compartment is provided with, at least, one passageway between an upper surface and a lower surface of said sealed first compartment.

8. The beverage containing system according to claim 7, wherein said sealed first compartment is provided with a plurality of passageways between said upper surface and said lower surface thereof.

9. A beverage containing system, comprising:

a sealed drink can having located therein both a liquid to be consumed and a sealed first compartment, said sealed first compartment being positioned substantially centrally with respect to a cylindrical wall of said sealed drink can and being further divided into at least two sub-compartments, and a second compartment being a second, sealed sub-compartment within said sealed drink can;

means for rupturing a wall of said sealed first compartment of said sealed drink can, so that an interior area of one of said sub-compartments is in fluid communication with a second compartment, said means for rupturing a wall of said sealed first compartment of said sealed drink can comprising:

first rupturing means for enabling said sealed first compartment and said second compartment to be in fluid contact with one another; and, second rupturing means for putting one of said sealed first compartment or said second compartment in fluid contact with the entirety of said sealed drink can; and, a compressed fluid being located in one of said sub-compartments so that after rupturing the wall of said sealed first compartment of said sealed drink can, said compressed fluid is confined within said sealed first compartment and is not in contact with a beverage contained within said beverage containing system and, if so desired by a user, is capable of being released into said second compartment by rupturing an additional wall of said sealed first compartment.

10. The beverage containing system according to claim 9, wherein said second compartment is substantially the entire interior of said sealed drink can.

11. The beverage containing system according to claim 9, wherein said sealed first compartment is positioned transversely with respect to a longitudinal axis of said sealed drink can.

12. The beverage containing system according to claim 9, wherein said second compartment is located within a device separate from said sealed drink can.

13. The beverage containing system according to claim 9, wherein said sealed first compartment is provided with, at least, one passageway between an upper surface and a lower surface of said sealed first compartment.

14. The beverage containing system according to claim 13, wherein said sealed first compartment is provided with a plurality of passageways between said upper surface and said lower surface thereof.

15. The beverage containing system according to claim 9, wherein said compressed fluid is a liquid having a boiling point below 0° C.

16. The beverage containing system according to claim 15, wherein said compressed fluid is liquid nitrogen.

17. The beverage containing system according to claim 15, wherein said compressed fluid is carbon dioxide.

18. A beverage containing system, comprising:

a sealed drink can having located therein both a liquid to be consumed and a sealed first compartment, said sealed first compartment being positioned substantially centrally with respect to a cylindrical wall of said sealed drink can and being further divided into at least two sub-compartments; said sealed first compartment being further provided with a plurality of passageways between an upper surface and a lower surface of said sealed first compartment;

means for rupturing a wall of said sealed first compartment of said sealed drink can, so that an interior area of one of said sub-compartments is in fluid communication with a second compartment; and, a compressed fluid being located in one of said sub-compartments so that after rupturing the wall of said sealed first compartment of said sealed drink can, said compressed fluid is confined within said sealed first compartment and is not in contact with a beverage contained within said beverage containing system and, if so desired by a user, is capable of being released into said second compartment by rupturing an additional wall of said sealed first compartment.

19. The beverage containing system according to claim 18, wherein said second compartment is substantially the entire interior of said sealed drink can.

20. The beverage containing system according to claim 18, wherein said second compartment is a second, sealed sub-compartment within said sealed drink can.

21. The beverage containing system according to claim 18, wherein said sealed first compartment is positioned transversely with respect to a longitudinal axis of said sealed drink can.

22. The beverage containing system according to claim 18, wherein said second compartment is located within a device separate from said sealed drink can.

23. The beverage containing system according to claim 18, wherein said compressed fluid is a liquid having a boiling point below 0° C.

24. The beverage containing system according to claim 23, wherein said compressed fluid is liquid nitrogen.

25. The beverage containing system according to claim 23, wherein said compressed fluid is carbon dioxide.

* * * * *